US006264491B1

(12) United States Patent
Lord

(10) Patent No.: US 6,264,491 B1
(45) Date of Patent: Jul. 24, 2001

(54) QUICK RELEASE SPRING CONNECTOR FOR COMPUTER CABLE

(75) Inventor: Charles Lord, Scottsdale, AZ (US)

(73) Assignee: Mobility Electronics, Scottsdale, AZ (US)

( * ) Notice: Subject to any disclaimer, the term of this patent is extended or adjusted under 35 U.S.C. 154(b) by 0 days.

(21) Appl. No.: 09/587,614

(22) Filed: Jun. 5, 2000

(51) Int. Cl.[7] ..... H01R 13/627

(52) U.S. Cl. ..... 439/358; 411/510; 411/913; 411/338; 439/350; 439/953

(58) Field of Search ..... 439/358, 357, 439/353, 350, 359, 352, 953; 411/508, 509, 510, 913, 385, 338, 339

(56) References Cited

U.S. PATENT DOCUMENTS 3,905,570 * 9/1975 Nieuwveld ..... 411/357
4,995,824 * 2/1991 Falco ..... 439/358
5,486,117 * 1/1996 Chang ..... 439/353
5,713,752 * 2/1998 Leong et al. ..... 439/358
5,741,102 * 4/1998 Everett et al. ..... 411/357
5,749,746 * 5/1998 Tan et al. ..... 439/358
5,775,931 * 7/1998 Jones ..... 439/358
6,165,002 * 12/2000 Kalis ..... 439/358

* cited by examiner

*Primary Examiner*—Tho D. Ta
(74) *Attorney, Agent, or Firm*—Jackson Walker LLP

(57) ABSTRACT

A clasp mechanism connector for quickly connecting a computer cable to a receiving member includes a body, a port connector and a biasing member. The biasing member maintains ratchet like teeth particularly useful in grasping internal threading such as that found in computer port housing. The connection apparatus securingly connects the cable connector to a traditional jack screw-type receiving member via actuation of the biasing member. The biasing member may preferably be a resilient member such as a spring or spring-like mechanism.

21 Claims, 3 Drawing Sheets

QUICK RELEASE SPRING CONNECTOR FOR COMPUTER CABLE

BACKGROUND OF THE INVENTION

1. Technical Field of the Invention

The present invention relates generally to port connection devices including serial, parallel and video port connectors, and, more particularly, to a computer port connector that can be selectively coupled to a mating connector.

2. Description of Related Art

In the market of portable electronic devices such as laptop computers and personal digital assistants (PDA's), a need has been established to expedite the connection and disconnection of the main computer to the peripheral devices (printers, monitors digital projectors, modem, for example)

Traditional means has been to couple the two mating sections of the connector and then thread screws located on the free cabled mating section of the connector into jack screw receptacles on the fixed mating section of the connector located on the laptop. Some connectors have captive screws, which the user is required to physically use a screwdriver to secure the connectors and some have an integral knob or handle to aid in the task. This means of securing the connection is time consuming and cumbersome.

What is needed is a connector for quick connection and disconnection while retaining and using the traditional jack screw receptacles common to all devices while still providing a secure means of attachment.

SUMMARY OF THE INVENTION

The present invention achieves technical advantages as a system and method for connecting the port connection device in a predetermined orientation in which the need for additional components and site lines have been alleviated. The present invention provides a method and user-friendly apparatus having a non screw-type port connector adapted to connect to a receiving member wherein the receiving member is capable of accepting a traditional jack screw connector having screw-type fasteners. The invention facilitates a more universal use of connection with traditional jack screw-type housing connectors that are commonly in use.

The present invention provides a method and a connector apparatus which securingly attaches to a common port receiving member, while remedying the need for additional tools or attachment means, such as screws. The invention makes connector the housing more usable by all users, handicapped or otherwise. It is well settled that many people having robotic limbs generally have a decreased ability to pick up and manipulate small objects. The present invention alleviates the use of screws or tools such that a person having decreased manipulative abilities may also use the device thereby making the application more universal.

The present invention also provides a method and an apparatus for secure attachment of the port connection to a receiving member which alleviates the need for a site line, thereby alleviating the need for manipulation of the receptive housing. Depending on the size and shape of a computer housing, manipulation of the machine may be difficult. However, if such a need is obviated, increased ease in connection of ports is facilitated.

The present invention also provides a method and an apparatus for securing a port mechanism wherein the risk of lost connection parts is allayed. The fewer the number of small parts, clearly it is less likely one should be missing any at the time of connection.

BRIEF DESCRIPTION OF THE DRAWINGS

For a more complete understanding of the present invention, reference is made to the following detailed description of the preferred embodiment taken in conjunction with the accompanying drawings, wherein like numerals refer to like elements, wherein.

DETAILED DESCRIPTION OF PREFERRED EMBODIMENT

Figure 1:
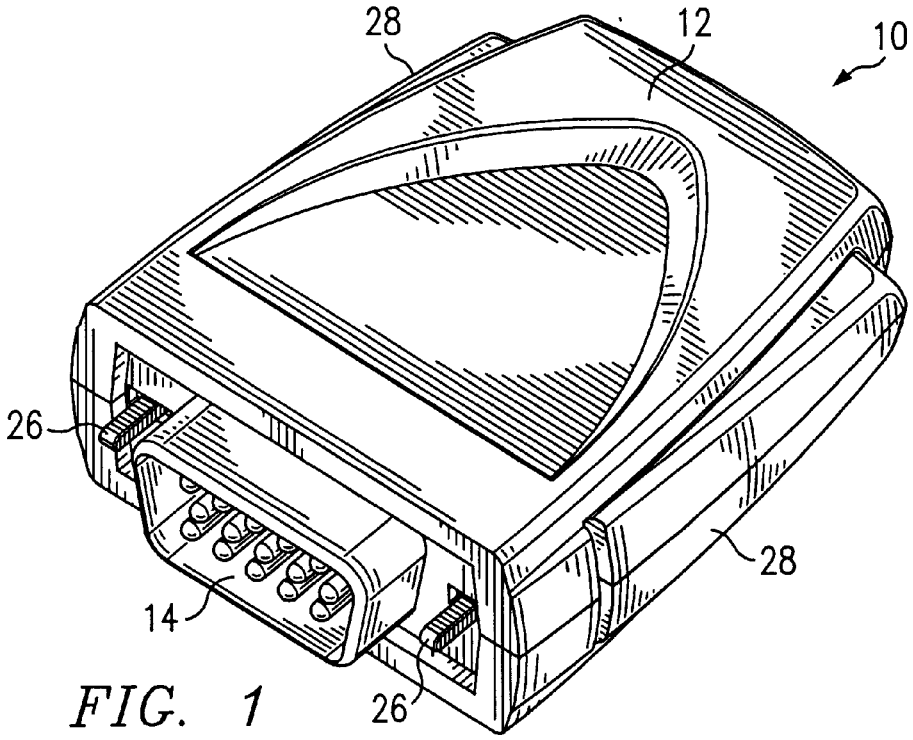
FIG. 1 is a perspective view illustrating a preferred embodiment of the external housing.
Figure 2:
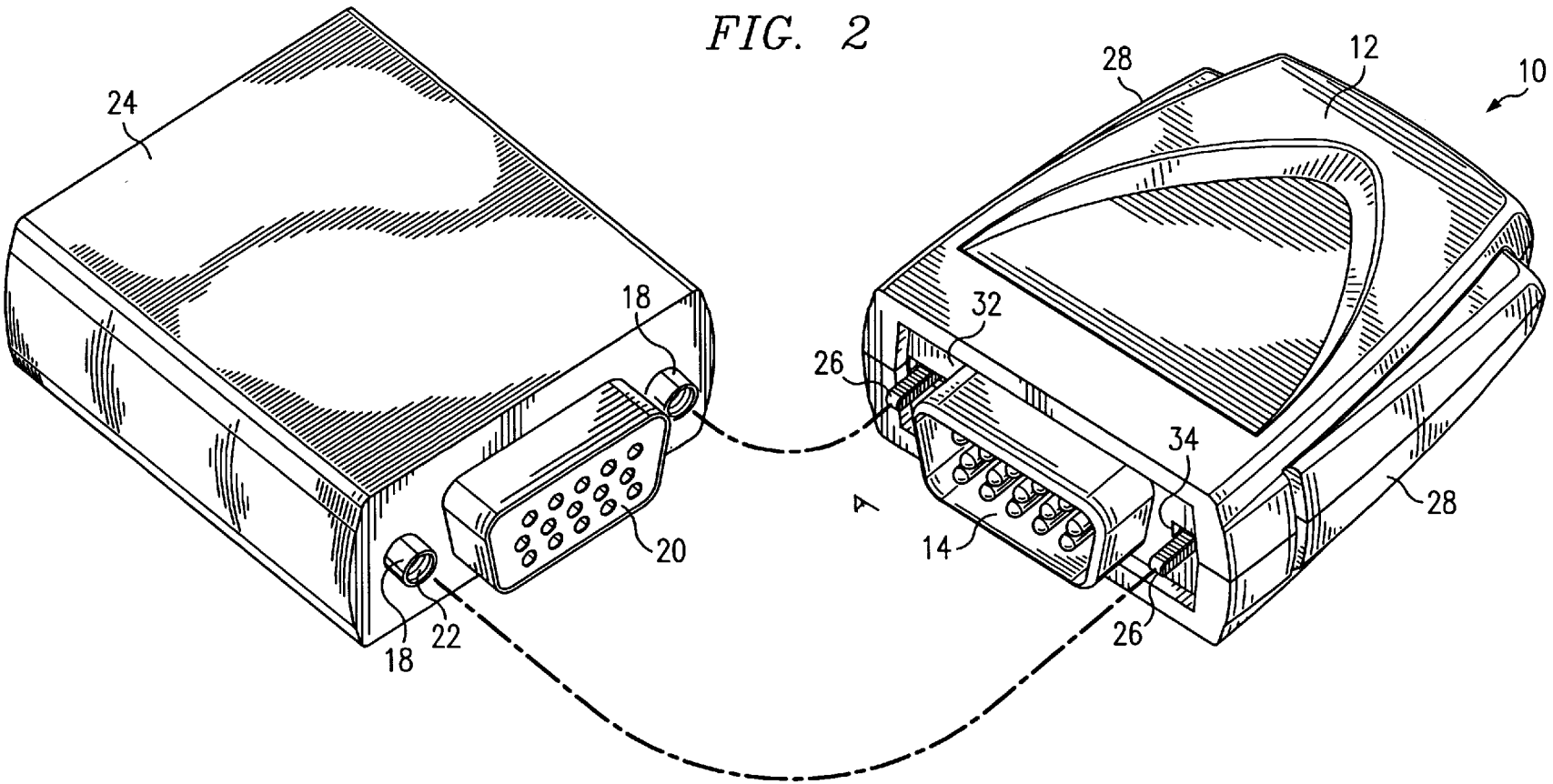
FIG. 2 is an exploded view of the connector adapted to couple to a conventional computer port receiving member.

The present invention provides a connector adapted to easily and quickly connect and disconnect to/from receiving member. The connector includes a housing maintaining a port connection and a clasp mechanism for releasingly and selectively securingly the port connection to the receiving member. In reference to FIG. 1 and FIG. 2, FIG. 1 is a perspective view illustrating the connector 10. The port connector 10 includes a housing 12 maintaining a port connection 14, biasing member 16 adapted to clasp to a mechanism 18 provided on a common port receiving member as shown in FIG. 2. The conventional port receiving member 20 maintains internal threading 22 in mechanism 18 to receive screws and anchor the port connection 14 to a receiving connector 24. The biasing member 16 has distal end prongs 26 each adapted to anchor the port connector 14 or the connector 10 to the port receiving member 20 via threading 22. In the preferred embodiment of the computer port connector 10, biasing member 16 is actuated via the manual compression of opposing side housing buttons 28 which respectively engage portions of biasing member 16.

Port connector 10 may be utilized for a variety of different uses depending upon the type of cable or wires maintained by the housing 12. The port connection 14 may be any type of port connection such as a parallel port, a serial port, video port, or any other means for port connection such as fiberoptic or infrared, for example.

FIG. 2 is an exploded perspective view of the connector 10 adapted to connect to port connector 20 using the clasp embodied as biasing member 16.

Figure 3:
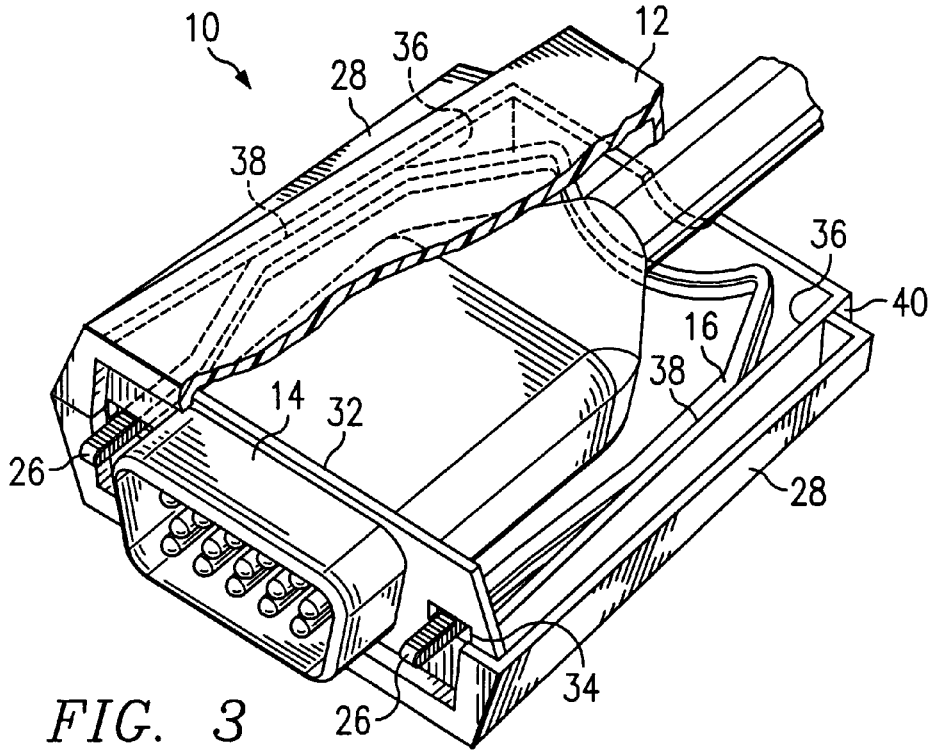
FIG. 3 is a sectional perspective view of the preferred embodiment of FIG. 1 illustrating an easy lock computer port connector.

FIG. 3 is a partial cutaway perspective of the preferred embodiment comprising the easy to lock computer port connector 10. The connector 10 comprises the housing 12, buttons 28, the port connection 14 maintained by the housing 12, and the biasing member 16, all previously shown in FIG. 1. FIG. 3 details the interior of the housing 12 wherein a front plate 32 receives and holds the biasing member 16 and the port connection 14 in place. When buttons 28 are actuated inwardly, biasing member 16 is responsibly compressed such that prongs 26 of the biasing member 16 are inwardly displaced within corresponding slots 34 of the plate 32. Each button 28 controls the compression of the receptacle prong 26. Such actuation of the prongs 26 facilitates the release of the connector device 10 by the release of the prongs 26 from the internal threading 22 of the receiving member 18.

In the preferred embodiment, distal end prongs 26 comprise tined or serrated outer surfaces defining grips as depicted in this figure. Such grips may be of a variety of shapes and sizes yet preferably are capable of, yet not limited to securingly connecting the port connection 14 to the receptive connector 24 by being received within and securing to screwtype port connectors mechanisms 18. Other means for securing the port connection 14 to a receptive connector 24 include but are not limited to ratchet systems, teeth, threading on the outer side of the distal end prongs 26 or other obvious variations, for example. Such prongs 26 may preferably be made of the same material as the biasing member 16, however, may also be made of other complementary materials such as elastics, elastomers, rubber or the like, disposed about the ends at biasing member 16 i.e., a sleeve.

Preferably actuation of the biasing member 16 is accomplished by compression of buttons 28. When buttons 28 are compressed inwardly, the inner surfaces 36 of buttons 28 correspondingly compress respective wings 38 of biasing member 16. Such compression of wings 38 correspondingly disposes the associated prongs 26 inwardly in the slots 34 of the plate 32, and in return in the interior of receptive connector mechanism 18. Release of the buttons 28 allows the biasing member 16 to spring outwardly until prongs 26 engage the outer edge of plate 32. Flanges 40 of buttons 28 maintain buttons 28 within housing 12.

Biasing member 16 may be of a variety of different configurations. Resilient materials and designs are preferable in the preferred embodiment of this design, however, uncompromising materials are not precluded in the manufacture of this mechanism. Preferable materials include, but are not limited to, springs or spring-like mechanisms, for example, however, obvious variations are not precluded. The embodiment depicted in FIG. 3 shows the biasing member 16 configured as a spring or spring-like mechanism. Moreover, which connector 10 is shown to be a male-type connector adapted to connect to a female receptive connector 24, the reverse orientation is possible.

Figure 4:
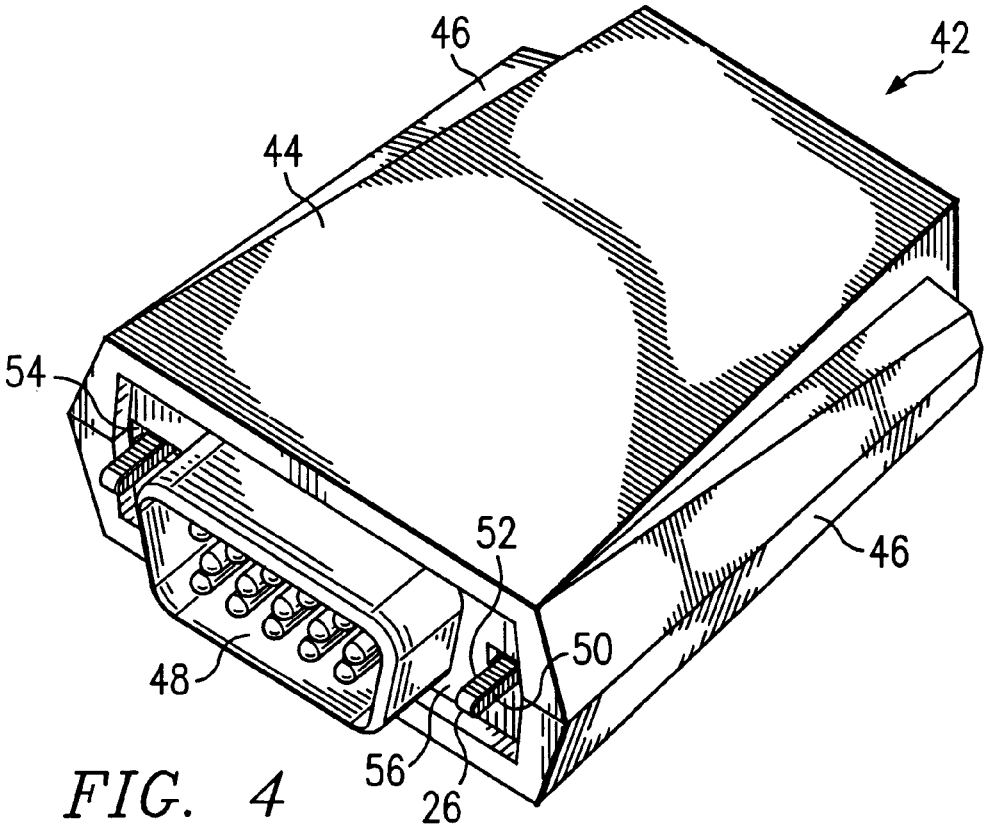
FIG. 4 is a perspective view of an alternative preferred embodiment for an easy lock computer port connector.

FIG. 4 is a pictorial view of an alternative embodiment of an easy to lock computer port connector 42. The computer port connector 42 depicted in this embodiment includes a housing 44 maintaining buttons 46, port connection 48 and a biasing member 50 terminating at grips 52. In this embodiment it is important to note biasing member 50 is capable of either inward or outward biasing within respective slots 54 in front plate 56. However, it is preferable to, for example, bias the member for actuation in the direction of the grips. For example, if inward biasing is preferable for the secure connection of the port connector 42 to a receiving member it might be deemed preferable to include the grips on the inward side, or side closest to the port connection 48, of the biasing member 50. Again, actuation is preferable via the compression of buttons 46 located on either side of the biasing member 50.

Figure 5:
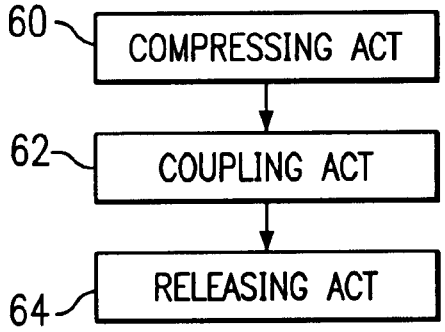
FIG. 5 is a block diagram showing the method of connecting the easy lock computer port housing to a receiving member.

FIG. 5 is a block diagram showing the method of connecting an easy to lock computer port housing to a receiving member, such as shown in the previously described FIGS. 1–4 as connector 10 and 42. As disclosed above, the act of compressing 60 comprises squeezing the biasing member (16, 50) via the actuation of buttons (28, 46) located on the lateral side of the housing of the device (12, 44). Once the biasing member is compressed, the connector (10,42) then may be coupled to receptive connector 24 at step 62 by inserting the retracted prongs 26 or grips 52 in the internally threaded members 22. Once coupled, the buttons (28, 46) may be released at step 64 for a secure fit of the prongs 26 or grips 52 within the receptive member 20, for example, thereby securing the connector (10, 42) to the receptive connector 24.

For our purposes the effort (work) one uses to actuate the biasing member 16 is a function of the motion of the pivot point of the biasing member 16 being a result of the force applied to the pivot point and the distance the prongs 26 or grips 52 move along a line of displacement. Thus, the location of the pivot point is critical to the amount of work necessary to the application of the device.

Lastly, although the buttons (28, 46) are shown to be side buttons for the lateral displacement of the biasing member 16, it is clear that buttons (28, 46) may be of a variety of different placements along the device such as the back, top and bottom of the device, for example.

Although preferred embodiments of the method and system of the present invention has been illustrated in the accompanied drawings and described in the foregoing detailed description, it is understood that obvious variations, numerous rearrangements, modifications and substitutions can be made without departing from the spirit and the scope of the invention as defined by the appended claims.

What is claimed is:

1. A non screw-type computer port connector connectable to a receiving member including at least one threaded hole which is capable of accepting a screw-type fastener, comprising:

a housing;

a port connection coupled to said housing and connected to a plurality of electrical conductors; and a clasp coupled to said housing and releasingly securable to the receiving member, actuable via displacement of said clasp wherein the clasp has distal ends each including a gripping structure securingly engageable with at least one thread of the at least one threaded hole of the receiving member.

2. The computer port connector of claim 1 wherein the housing maintains buttons adapted to actuate said clasp.

3. The computer port connector of claim 1 wherein the port connection is a parallel port connection.

4. The computer port connector of claim 1 wherein the port connection is a serial port connection.

5. The computer port connector of claim 1 wherein the port connection is a video port connection.

6. The computer port connector of claim 1 wherein said clasp is adapted to securingly engage multiple threads of said threaded recess.

7. The computer port connector of claim 1 wherein the clasp is a biasing member.

8. The computer port connector of claim 7 wherein the biasing member is biased inwardly towards an axial center of the connector.

9. The computer port connector of claim 7 wherein the biasing member is biased outwardly away from an axial center of the connector.

10. The computer port connector of claim 7 wherein the biasing member is resilient.

11. The computer port connector of claim 10 wherein the biasing member is a spring.

12. The computer port connector of claim 1 wherein the distal ends includes grips.

13. The computer port connector of claim 12 wherein the grips are teeth.

14. The computer port connector of claim 12 wherein the grips are elastic.

15. A non screw-type computer port connector connectable to a receiving member including at least one threaded hole which is capable of accepting a screw-type fastener, comprising:

a housing;

a port connection coupled to said housing and connected to a plurality of electrical conductors; and a clasp means coupled to said housing and releasingly securable to the receiving member, actuable via displacement of said clasp wherein said clasp means has distal ends each including a gripping structure securingly engageable with at least one thread of the at least one threaded hole of the receiving member.

16. A method of securing a non screw-type port connector to a receiving member having at least one threaded hole which is capable of accepting a screw-type fastener, comprising:

a port connection and a plurality of electrical conductors coupled to said port connection and a port clasp coupled to the port connection and has at least one distal end including a gripping structure;

comprising the step of:

coupling said port connection to the respective receiving member by displacing the clasp such that the gripping structure engages at least one thread of the at least one threaded hole of the receiving member.

17. The computer port connector of claim 16 wherein the clasp is a biasing member.

18. The computer port connector of claim 17 wherein the biasing member is biased outwardly.

19. The computer port connector of claim 16 wherein the distal ends includes grips.

20. The computer port connector of claim 19 wherein the grips are ratchet like.

21. The method of claim 20 wherein said clasp securingly engages multiple threads of said threaded recess.

* * * * *